US009062461B1

(12) United States Patent
Zelich

(10) Patent No.: US 9,062,461 B1
(45) Date of Patent: Jun. 23, 2015

(54) DOWNSPOUT EXTENDING DEVICE

(71) Applicant: Christopher G. Zelich, Grove City, OH (US)

(72) Inventor: Christopher G. Zelich, Grove City, OH (US)

( * ) Notice: Subject to any disclaimer, the term of this patent is extended or adjusted under 35 U.S.C. 154(b) by 0 days.

(21) Appl. No.: 14/612,583

(22) Filed: Feb. 3, 2015

Related U.S. Application Data

(60) Provisional application No. 61/965,650, filed on Feb. 5, 2014.

(51) Int. Cl.
*E04D 13/08* (2006.01)

(52) U.S. Cl.
CPC ..... *E04D 13/08* (2013.01); *E04D 2013/0846* (2013.01)

(58) Field of Classification Search
CPC ... E04D 13/08; E04D 13/068; E04D 13/0645; E04D 2013/0846
USPC ..... 52/16, 632; 138/106, 110; 403/109.2, 403/109.3; 285/302, 303, 7
See application file for complete search history.

(56) References Cited

U.S. PATENT DOCUMENTS

| | | | | | |
|---|---|---|---|---|---|
| 125,483 | A | * | 4/1872 | Prugh | 52/16 |
| 228,883 | A | * | 6/1880 | Freeman | 285/303 |
| 1,322,189 | A | * | 11/1919 | Holt | 52/13 |
| 1,889,711 | A | * | 11/1932 | Talley et al. | 285/303 |
| 2,446,256 | A | * | 8/1948 | Young | 210/445 |
| 2,660,457 | A | * | 11/1953 | Mallon | 285/7 |
| 2,669,358 | A | * | 2/1954 | Young | 210/460 |
| 3,336,060 | A | * | 8/1967 | Bradford | 403/108 |
| 3,347,575 | A | * | 10/1967 | Morris | 403/107 |
| 3,366,406 | A | * | 1/1968 | Morris | 403/107 |
| 3,799,099 | A | * | 3/1974 | Conover | 114/221 R |
| 4,114,927 | A | * | 9/1978 | Butcher | 285/7 |
| 4,173,361 | A | * | 11/1979 | Gagas | 285/64 |
| 4,247,216 | A | * | 1/1981 | Pansini | 403/109.3 |
| 4,641,464 | A | * | 2/1987 | Andersson et al. | 52/16 |
| 4,875,424 | A | * | 10/1989 | Baldwin | 114/39.12 |
| 5,171,052 | A | * | 12/1992 | Cunningham | 294/210 |
| 5,220,755 | A | * | 6/1993 | Roles | 52/16 |
| 5,867,944 | A | * | 2/1999 | Attaway | 52/16 |
| 6,270,133 | B1 | * | 8/2001 | Babcock | 294/15 |
| 6,371,686 | B1 | * | 4/2002 | Wu | 403/377 |
| 6,669,552 | B1 | * | 12/2003 | Beer | 454/171 |
| 7,065,924 | B2 | * | 6/2006 | Wade | 52/16 |
| 7,895,793 | B1 | * | 3/2011 | Yates | 52/12 |
| 8,730,665 | B2 | * | 5/2014 | Lewis et al. | 361/679.49 |
| 2011/0000574 | A1 | * | 1/2011 | Nicewicz et al. | 138/155 |
| 2011/0084475 | A1 | * | 4/2011 | Abbasi et al. | 285/15 |

FOREIGN PATENT DOCUMENTS

| | | | | | |
|---|---|---|---|---|---|
| DE | 3320623 | A1 | * | 12/1984 | E04D 13/08 |
| JP | 54153322 | A | * | 12/1979 | E04D 13/08 |

* cited by examiner

*Primary Examiner* — Robert Canfield
(74) *Attorney, Agent, or Firm* — Dan Shifrin

(57) ABSTRACT

A downspout extending device is provided, comprising: an outer sleeve having a first end configured to receive an end of a first section of a downspout system; an insert slideable within the sleeve and extendable from a second end of the outer sleeve, the insert having an outer end configured to receive an end of a second section of the downspout system and an inner end remaining inside the sleeve when the insert is extended; and a locking mechanism configured to maintain the insert in a fixed position within the sleeve, whereby the downspout extending device couples the first and second sections of the downspout system.

8 Claims, 6 Drawing Sheets

DOWNSPOUT EXTENDING DEVICE

RELATED APPLICATION DATA

The present application is related to, and claims the benefit of, U.S. Application Ser. No. 61/965,650, entitled DOWNSPOUT EXTENDING DEVICE and filed on Feb. 5, 2014, which application is incorporated herein by reference in its entirety.

TECHNICAL FIELD

The present invention relates generally to downspouts and, in particular, to downspout connectable extensions.

BACKGROUND ART

Downspouts are used to allow rainwater that falls on a building's roof and is collected by a gutter system to flow to the ground in a controlled manner. Downspouts are typically assembled from lengths of rectangular tubing connected to the gutter and each other with screws. Depending on the geometry of the gutter and side of the building, elbows (offsets) of various angles, Y's, T's, and short extensions may be necessary to maintain a proper flow angle as well as be desirable for aesthetic reasons. Straps, brackets or other like hardware are used to secure the downspout sections to the building wall.

FIGS. 1 and 2 illustrate the number and types of components and connections that may be used in even some basic downspout applications. It will be apparent that disassembly and re-assembly can be difficult when it is necessary to make repairs to a downspout, siding, or wall or when connecting or disconnecting the lower end of a downspout to an underground drain tile or pipe.

SUMMARY OF THE INVENTION

The present invention provides a downspout extending device. The device comprises: an outer sleeve having a first end configured to receive an end of a first section of a downspout system; an insert slideable within the sleeve and extendable from a second end of the outer sleeve, the insert having an outer end configured to receive an end of a second section of the downspout system and an inner end remaining inside the sleeve when the insert is extended; and a locking mechanism configured to maintain the insert in a fixed position within the sleeve, whereby the downspout extending device couples the first and second sections of the downspout system.

The present invention also provides a method of connecting a first section of a downspout system to a second section of the downspout system. The method comprises: placing a downspout extending device between an open end of the first section and an open end of the second section of the downspout system, the downspout extending device having an outer sleeve with a first end and further having an insert slideable within the sleeve and extendable from a second end of the outer sleeve, the insert having an enlarged outer end and further having a first leaf spring secured at a first end to a first location on an inner wall of the insert and biased toward the inner wall of the insert, the first leaf spring having a first snap button secured to an opposite end and protruding through a first hole in the insert; placing the first end of the sleeve over the open end of the first section of the downspout system; extending the insert from the sleeve such that the enlarged outer end of the insert is placed over the second open end of the second downspout section; and allowing the first snap button to protrude through a first hole in the sleeve, whereby the insert is locked in a fixed position within the sleeve.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
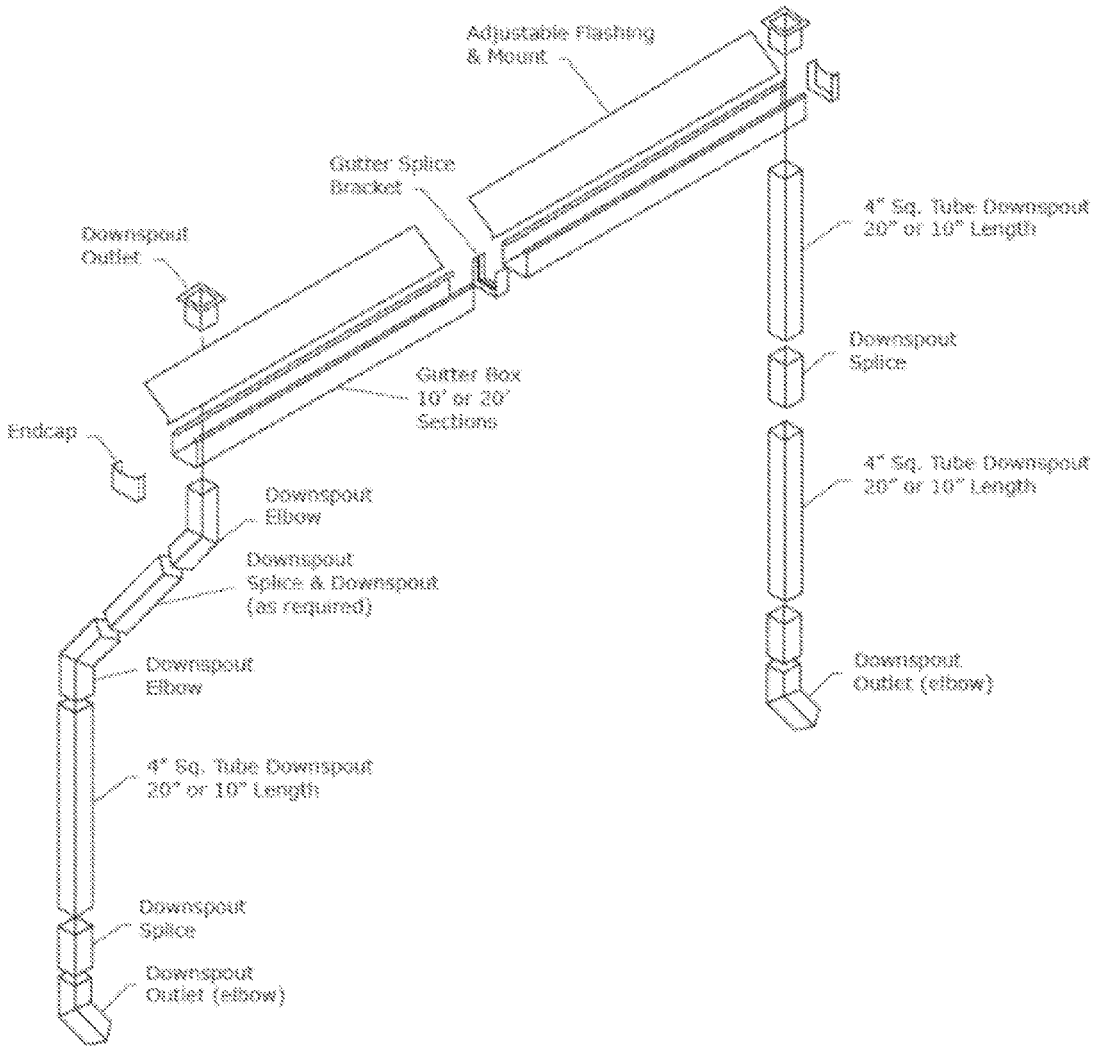
FIG. 1 (Prior Art)
FIG. 1 is a perspective view of a typical disassembled prior art gutter and downspout configuration using prior art components.
Figure 2:
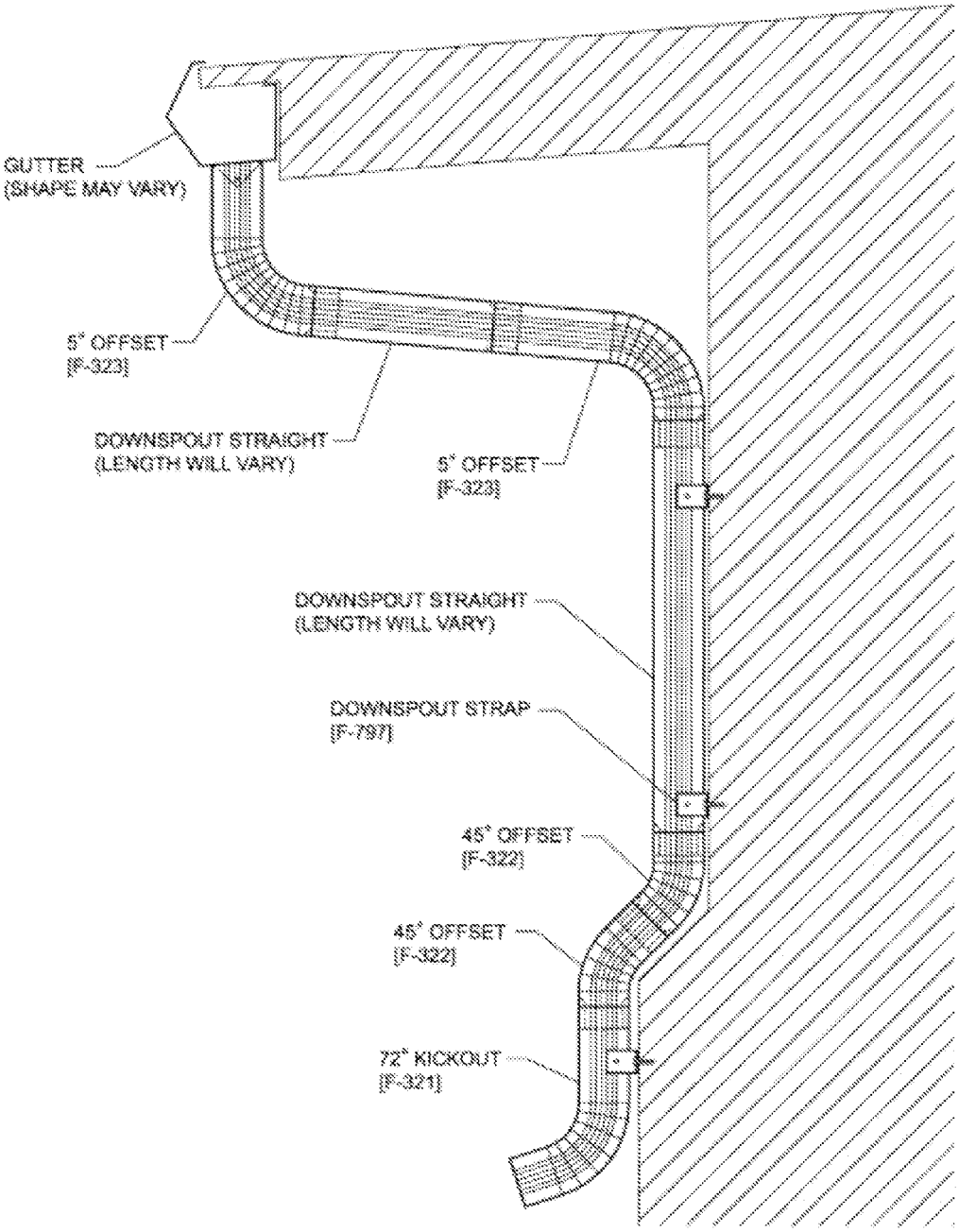
FIG. 2 (Prior Art)
FIG. 2 is a side view of another typical prior art gutter and downspout configuration using prior art components.
Figure 3:
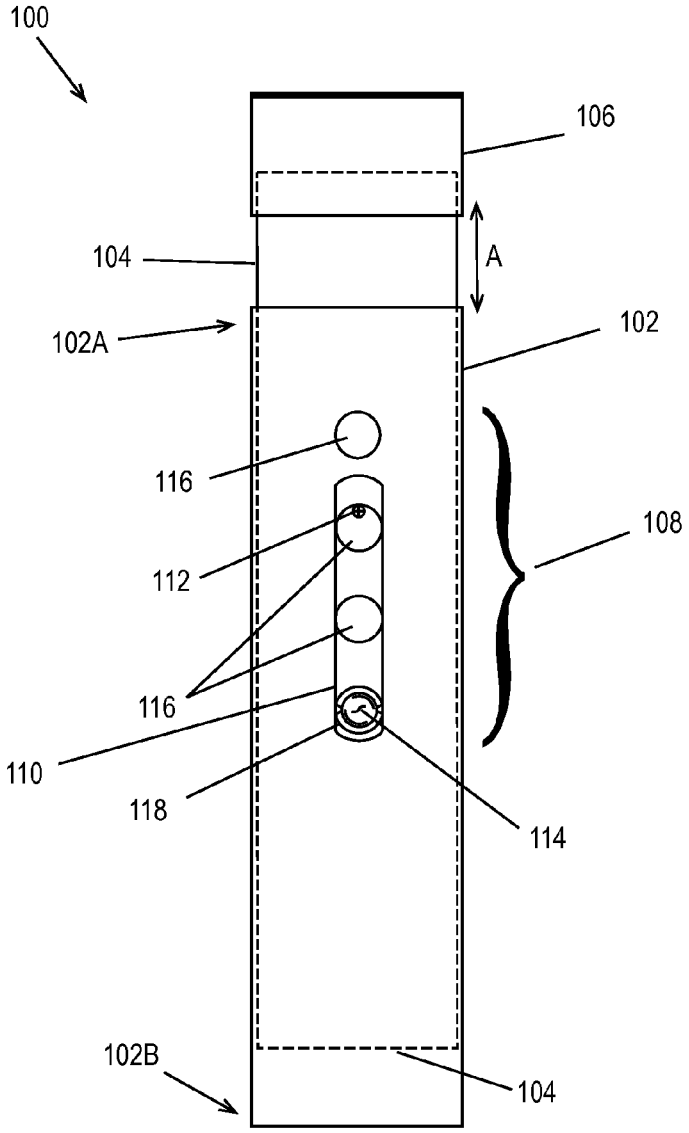
FIG. 3 is side view of an embodiment of a downspout extending device of the present invention.

FIG. 3 is side view of an embodiment of a downspout extending device 100 of the present invention. The device 100 includes an outer sleeve 102, with two ends 102A, 102B, and an insert 104 that slides within the sleeve 102 (see arrow 'A') and is extendable from one end of the outer sleeve 102. (In the Figures, the dashed lines represent inner walls of the sleeve 102 and insert 104.) The sleeve 102 has internal cross-sectional dimensions that are slightly larger than the outside cross-sectional dimensions of a conventional downspout. The insert 104, while having smaller cross-sectional dimensions than the inside dimensions of the sleeve 102, has an enlarged outer end section 106 that extends beyond one end 102A of the sleeve 102. The enlarged end section 106 is also slightly larger than the outside dimensions of a conventional downspout section. Thus, both the sleeve 102 and the end section 106 of the insert 104 are configured to receive ends of conventional downspout sections. Preferably, both the enlarged end section 106 and the opposite end 102B of the sleeve 102 are corrugated or otherwise able close around the end of a section of downspout. While the downspout extending device 100 is shown in the Figures to have a rectangular cross-section, it will be appreciated that it may be manufactured with other cross-sectional shapes, such as circular, to accommodate a variety of types of downspouts.

The downspout extending device 100 also includes a mechanism, indicated generally by the brace 108 in FIG. 3, to lock the insert 104 in a fixed position relative to the sleeve 102. The locking mechanism 108 includes a leaf spring 110 secured to the inner wall of the insert 104. The leaf spring 110 is secured at one end to the insert 104 by a rivet 112 or other like means and has a snap button 114 at the opposite end which protrudes through a hole 118 in the insert 104. A hole, or a number of spaced apart holes 116, three of which are illustrated in FIG. 3, may be formed through the sleeve 102. The snap button 114 and holes 116 are dimensioned such that the snap button 114 can extend through the holes 116 when the insert is in different positions within the outer sleeve 102. When the snap button 114 extends through a hole 116 in the sleeve 102, the insert 104 is locked in a fixed position within the sleeve 102. When the snap button 114 is pushed downward against the bias of the leaf spring 110, the insert 104 may be slid within the sleeve 102 as indicated by the arrow 'A' into a different position with the snap button 114 protrudes through a different hole 116 in the sleeve 102. In one embodiment, the downspout extending device 100 includes two locking mechanisms 108 on opposites sides of the insert 104, as illustrated generally by locking mechanisms 108A, 108B in FIGS. 5A, 5B and 6A, 6B having leaf springs 110A, 110B, snap buttons 114A, 114B, and holes 116A, 116B, respectively.

Figure 4:
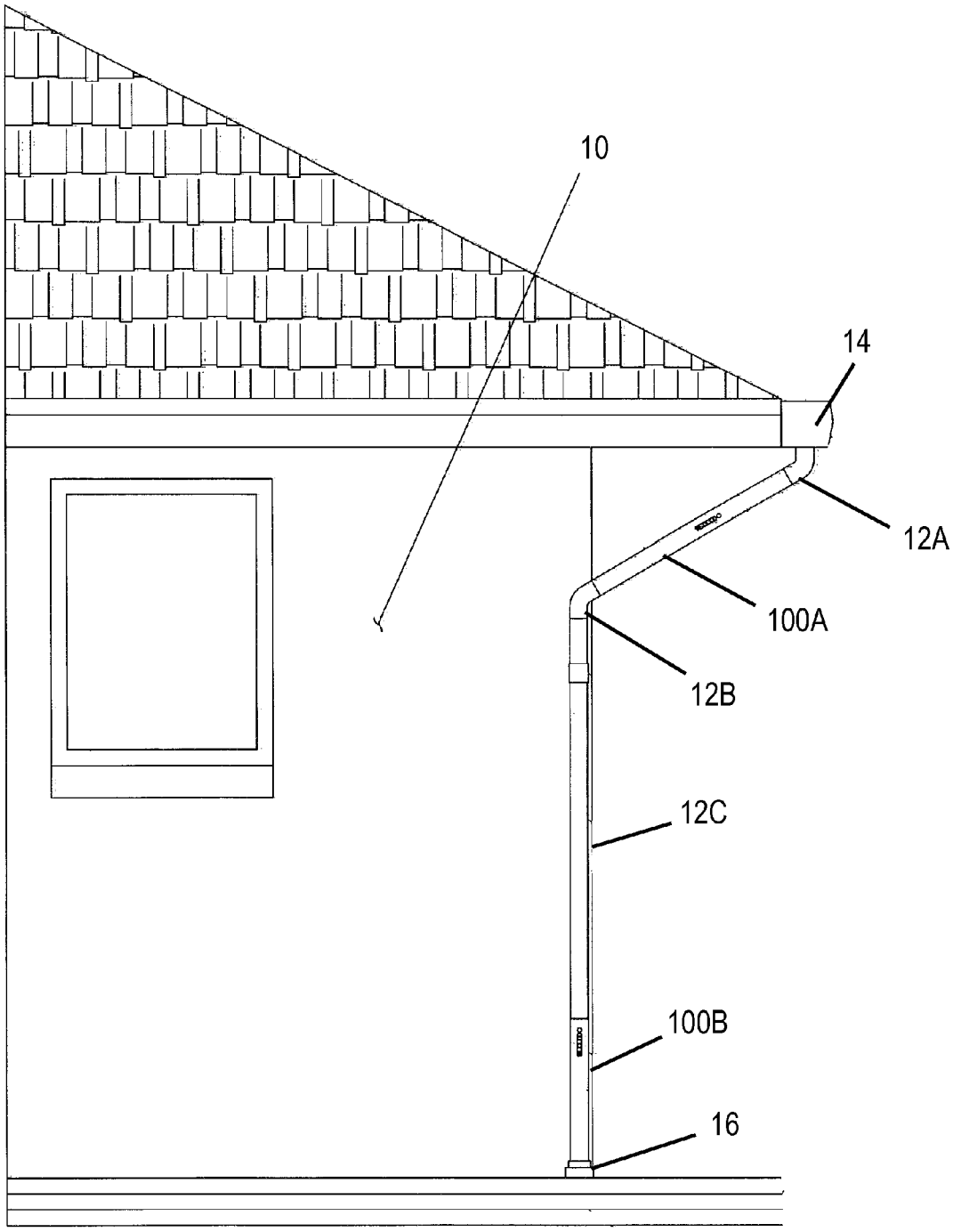
FIG. 4 illustrates an example of two downspout extending devices of FIG. 3 in use with a downspout system.

FIG. 4 illustrates examples of the use of the downspout extending device 100 in a downspout system attached to a house 10. One device 100A connects one elbow section 12A, itself connected to a gutter 14, to another elbow section 12B. A second device 100B couples a vertical downspout section 12C to a drain 16. The sleeve 102 and insert 104 may be fabricated in a variety of lengths in order to span various distances between downspout sections to be connected. Further, providing multiple holes 116 gives one device 100 the ability to span different distances between adjacent downspout sections.

Figure 5A:
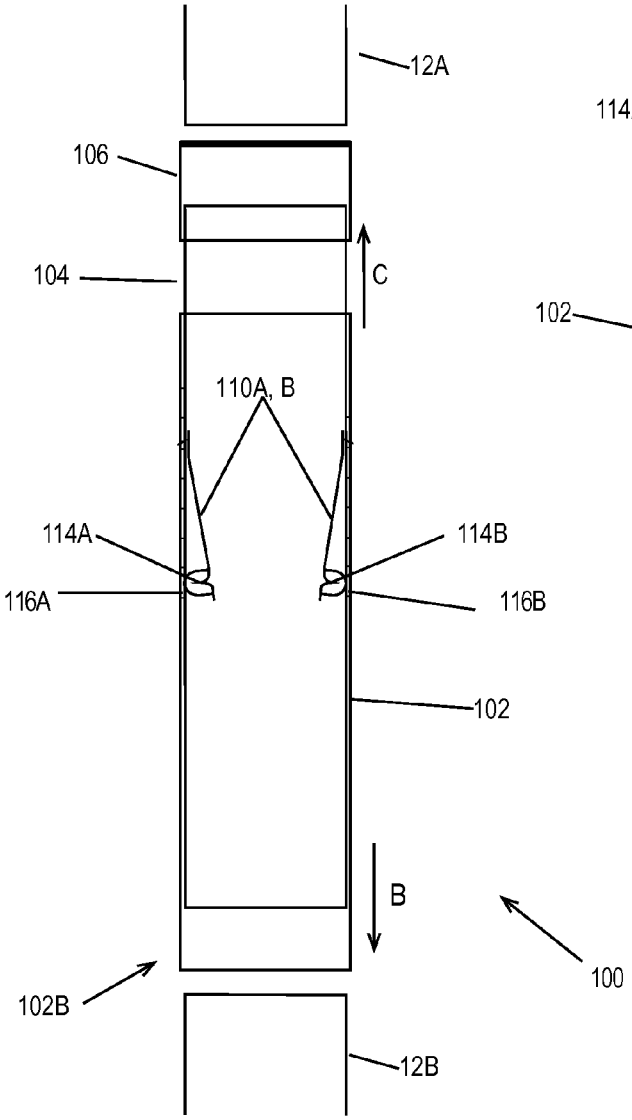
FIG. 5A is a cut-away side view of the downspout extending device of FIG. 3 with the snap buttons disengaged.
Figure 5B:
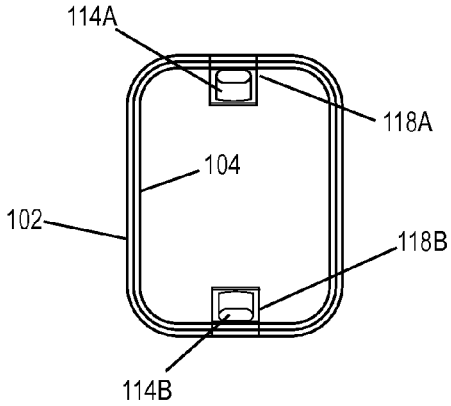
FIG. 5B is a cut-away top view of the downspout extending device of FIG. 3 with the snap buttons disengaged.
Figure 6A:
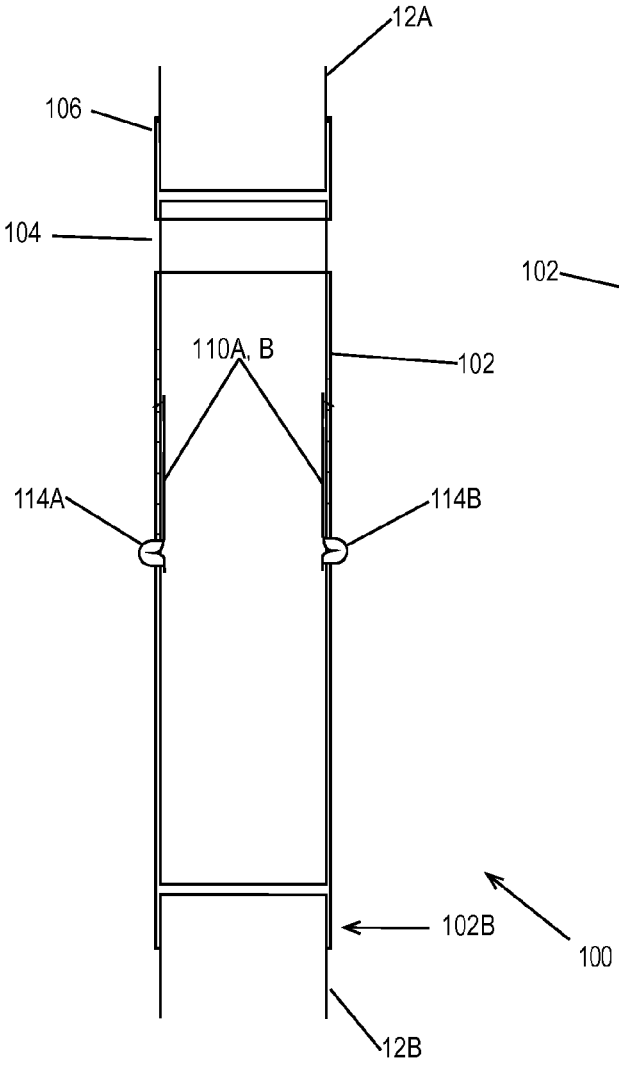
FIG. 6A is a cut-away side view of the downspout extending device of FIG. 3 with the snap buttons engaged.
Figure 6B:
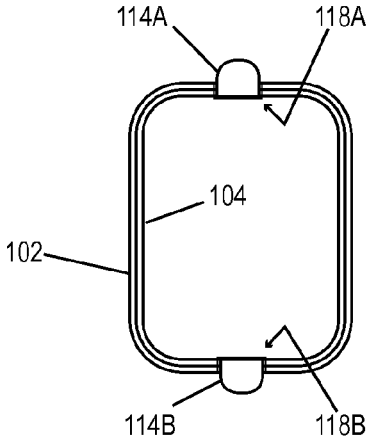
FIG. 6B is a cut-away top view of the downspout extending device of FIG. 3 with the snap buttons engaged.

The use of the downspout extending device 100 will be described with reference first to FIGS. 5A, 5B and then to FIGS. 6A, 6B. If needed, the device 100 is first collapsed in length by pushing the snap buttons 114A, 114B inward through the holes 116A, 116B in the sleeve 102 and pushing the insert 104 into the sleeve 102 until the length of the device 100 is less than the distance between the ends of two sections of downspout 12A, 12B that are to be coupled. The device 100 may then be placed between the ends of two sections of downspout 12A, 12B. One end 102A of the outer sleeve 102 is placed over the end of a first section of downspout, 12B in the FIGs., as indicated by the arrow 'B.' With the snap buttons 114A, 114B pushed inward through the holes 116A, 116B in the sleeve 102, the insert 104 may be extended, as indicated by the arrow 'C', such that the enlarged outer end section 106 of the insert 104 is placed over the end of the other downspout section 12A, while leaving the other, inner end of the insert 104 within the sleeve 102. When the snap buttons 114A, 114B align with respective holes 116A, 116B in the sleeve 102, the snap buttons 114A, 114B snap through the holes 116A, 116B (FIGS. 6*a*, 6B), biased by their respective leaf springs 110A, 110B. The device 100 may thus be locked in place between the two sections 12A, 12B of the downspout system and water may flow freely from the gutter 14 through the first downspout section 12A, through the device 100, and into the other downspout section 12B. To provide at least partial sealing of the joints between the ends 106 and 102B of the device 100 and the downspout sections 12A, 12B, the ends 106 and 102B may be crimped around the ends of the downspout sections 12A, 12B.

In addition, the force of the device 100 on the downspout sections 12A, 12B in the directions indicated by the arrows 'A' and 'B' may provide some structural support for the downspout system and reduce the number of straps typically used to secure a downspout system to a building.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A downspout extending device, comprising:

an outer sleeve having a first end configured to receive an end of a first section of a downspout system;

an insert slideable within the sleeve and extendable from a second end of the outer sleeve, the insert having an outer end configured to receive an end of a second section of the downspout system and an inner end remaining inside the sleeve when the insert is extended; and a locking mechanism configured to maintain the insert in a fixed position within the sleeve, whereby the downspout extending device couples the first and second sections of the downspout system wherein the locking mechanism comprises:

a first leaf spring secured at a first end to a first location on an inner wall of the insert and biased toward the inner wall of the insert; and a first snap button secured to an opposite end the first leaf spring and protruding through a first hole in the inner wall, the first snap button protrudable through a first hole in the sleeve;

wherein:

when the first snap button protrudes through the first hole in the sleeve, the insert is locked in the fixed position within the sleeve; and when the first snap button is pressed through the first hole in the sleeve against the bias of the first leaf spring, the insert is slidable within the sleeve.

2. The downspout extending device of claim 1, wherein the first hole in the sleeve is one of a plurality of spaced apart holes in the sleeve, whereby the insert is lockable in a like plurality of positions within the sleeve.

3. The downspout extending device of claim 1, wherein the locking mechanism further comprises:

a second leaf spring secured at a first end to a second location opposite the first location on the inner wall of the insert and biased toward the inner wall of the insert; and a second snap button secured to an opposite end the second leaf spring and protruding through a second hole in the inner wall, the second snap button protrudable through a second hole formed in the sleeve;

wherein:

when the first and second snap buttons protrude through the first and second holes, respectively, in the sleeve, the insert is locked in the fixed position within the sleeve; and when the first and second snap buttons are pressed through the first and second holes, respectively, in the sleeve against the bias of the first and second leaf springs, the insert is slidable within the sleeve.

4. The downspout extending device of claim 3, wherein:

the first hole in the sleeve is one of a first plurality of first spaced apart holes in the sleeve;

and the second hole in the sleeve is one of a second, like plurality of second spaced apart holes in the sleeve on the opposite side of the sleeve from the first plurality of spaced apart holes;

whereby the insert is lockable in the like plurality of positions within the sleeve.

5. A method of connecting a first section of a downspout system to a second section of the downspout system, comprising:

placing a downspout extending device between an open end of the first section and an open end of the second section of the downspout system, the downspout extending device having an outer sleeve with a first end and further having an insert slideable within the sleeve and extendable from a second end of the outer sleeve, the insert having an enlarged outer end and further having a first leaf spring secured at a first end to a first location on an inner wall of the insert and biased toward the inner wall of the insert, the first leaf spring having a first snap button secured to an opposite end and protruding through a first hole in the insert;

placing the first end of the sleeve over the open end of the first section of the downspout system;

extending the insert from the sleeve such that the enlarged outer end of the insert is placed over the second open end of the second downspout section; and allowing the first snap button to protrude through a first hole in the sleeve, whereby the insert is locked in a fixed position within the sleeve.

6. The method of claim 5, wherein the first hole in the sleeve is one of a plurality of spaced apart holes in the sleeve, whereby the insert is lockable in a like plurality of fixed positions within the sleeve.

7. The method of claim 5, wherein:

the insert further has a second leaf spring secured at a first end to a second location on an inner wall of the insert opposite the first location and biased toward the inner wall of the insert, the second leaf spring having a second snap button secured to an opposite end and protruding through a second hole in the insert;

the method further comprising, while allowing the first snap button to protrude through the first hole in the sleeve, allowing the second snap button to protrude through a second hole in the sleeve, whereby the insert is locked in the fixed position within the sleeve.

8. The method of claim 7, wherein:

the first hole in the sleeve is one of a first plurality of spaced apart holes in the sleeve; and the second hole in the sleeve is one of a second, like plurality of spaced apart holes in the sleeve on the opposite side of the sleeve from the first plurality of spaced apart holes;

whereby the insert is lockable in the like plurality of fixed positions within the sleeve.

* * * * *